US006554067B1

(12) United States Patent
Davies et al.

(10) Patent No.: US 6,554,067 B1
(45) Date of Patent: Apr. 29, 2003

(54) WELL COMPLETION PROCESS FOR FORMATIONS WITH UNCONSOLIDATED SANDS

(75) Inventors: David K. Davies, Kingwood, TX (US); Julius J. Mondragon, III, Redondo Beach, CA (US); Philip Scott Hara, Monterey Park, CA (US)

(73) Assignee: Tidelands Oil Production Company, Long Beach, CA (US)

( * ) Notice: Subject to any disclaimer, the term of this patent is extended or adjusted under 35 U.S.C. 154(b) by 0 days.

(21) Appl. No.: 09/855,996

(22) Filed: May 14, 2001

(51) Int. Cl.[7] ..... E21B 33/13
(52) U.S. Cl. ..... 166/276; 166/288; 166/303
(58) Field of Search ..... 166/250.14, 276, 166/285, 288, 303, 310

(56) References Cited

U.S. PATENT DOCUMENTS

| | | | | | |
|---|---|---|---|---|---|
| 3,205,946 | A | * | 9/1965 | Prats et al. | 166/288 |
| 3,438,443 | A | * | 4/1969 | Treet et al. | 166/288 |
| 3,515,216 | A | * | 6/1970 | Geis | 166/288 |
| 3,522,845 | A | * | 8/1970 | Bauer | 166/288 |
| 3,974,877 | A | * | 8/1976 | Redford | 166/288 |

* cited by examiner

*Primary Examiner*—William Neuder
(74) *Attorney, Agent, or Firm*—Sheppard, Mullin, Richter & Hampton LLP; Oral Caglar

(57) ABSTRACT

A method for consolidating sand around a well, involving injecting hot water or steam through well casing perforations in to create a cement-like area around the perforation of sufficient rigidity to prevent sand from flowing into and obstructing the well. The cement area has several wormholes that provide fluid passageways between the well and the formation, while still inhibiting sand inflow.

11 Claims, 4 Drawing Sheets

WELL COMPLETION PROCESS FOR FORMATIONS WITH UNCONSOLIDATED SANDS

This invention was made with Government support under DE-FC22-95BC14939 awarded by the Department of Energy. The Government has certain rights in this invention.

BACKGROUND OF THE INVENTION

This invention relates generally to methods for constructing wells, and, more particularly, to a method for completing a well in a sub-surface geologic formation with unconsolidated sands. Priority is claimed from U.S. Application Ser. No. 09/413,092, filed Oct. 5, 1999, which in turn claims priority from U.S. Provisional patent application Ser. No. 60/103,181, filed on Oct. 5, 1998, incorporated herein by reference.

Methods and apparatus for drilling wells have been in use for many years in a variety of industries, including in the oil production industry. In the oil production industry, wells are constructed downward into sub-surface geologic formations of sand for purposes of withdrawing reservoir fluids (oil, water, gas or the like) or for injecting steam into the formation to heat oil in the formation, which is then more easily withdrawn through an adjacent well. The methods and apparatus vary according to the types of sub-surface geologic formations through which the well passes.

A well typically is formed by incrementally inserting a "well casing" into new sections of well hole. The well casing is a metal pipe through which drilling equipment, reservoir fluids or steam can pass. The well casing extends downward to a sub-surface formation of interest. Well casings that extend downward to end in sub-surface sand formations are subject to "sand inflow" problems that can partially or wholly obstruct the well. In particular, in situations where a well casing terminates in a sub-surface sand formation, the sand can flow into the well much like sand through an hourglass. Such a sub-surface sand formation is known as an "unconsolidated" sand formation.

Sand inflow is a particular problem where a well casing has more than one hole along its length. A well casing can have multiple holes along its length to allow reservoir fluids to flow into the well from the formation or to allow steam from the well to be injected into the formation. Sand can flow into the well through such holes, obstructing the well casing and possibly obstructing other holes in the well casing as well.

One way to prevent sand inflow is to construct the well with gravel-packed, slotted liners; as is known in the industry. However, such liners are expensive to install and can limit entry of fluid into or out of the well bore. Furthermore, wells with such liners are expensive to repair or modify.

Accordingly, there has existed a need for an improved well completion process that will limit sand inflow from sub-surface geologic formations having unconsolidated sands. The present invention satisfies this need.

SUMMARY OF THE INVENTION

The present invention provides a geochemical well completion process that will limit said inflow from formations having unconsolidated sands. In particular, and by way of example only, the well completion process can be used in the construction of wells into sandy formations for the injection of fluid or the removal of reservoir fluids, such as oil, gas, water or the like. The process can also be applied to repairing existing well completions that have been damaged and can no longer prevent sand inflow into the well.

In particular, the invention provides for the application of a geochemical process to complete a new or existing well into a geologic formation consisting of unconsolidated sands utilizing one or more of the below methods, in combination or singly.

One embodiment of the method includes injecting alkaline water into the formation at high temperatures above 250° C. and with pH greater than 10 through a limited number of 0.25–0.50 inch diameter perforations to dissolve the sand grains in a near-wellbore region. Significant heat loss and fluid pH reduction occurs in the near-wellbore region as the hot injected fluids go through the perforations, mix with the formation waters, and disperse into the formation sands. The resultant temperature and fluid pH decline rapidly with distance from the wellbore which causes reprecipitation of the dissolved sand grain minerals (primarily calcium, magnesium, aluminum, iron, barium, sodium, sulfur, and silica) into complex synthetic silicate cements which bond the remaining unconsolidated sand grains in the formation around the well to control sand inflow into the well.

Another embodiment applies to geologic formation sands which are unconsolidated but do not contain adequate quantities of the minerals needed to create the complex synthetic silicate cements. The necessary minerals are added and solubilized into the high temperature alkaline water prior to injecting the fluid through the perforations so the dissolved formation sand grains. The supplemental solubilized minerals can react with the formation waters in the near-wellbore region to create the complex synthetic silicate cements to bond the unconsolidated sand grains around the well and thereby control sand inflow into the well.

In another embodiment, the method can include injecting high temperature steam at pressure greater than saturated steam pressures and at steam qualities sufficiently high enough to cause the steam condensate effluent to have an alkaline pH greater than 10. The effluent dissolves the formation sand grains in the near-wellbore region and creates a layer of consolidated sand around the well to thereby control sand inflow into the well.

In yet another embodiment, the method can include injecting high temperature steam at pressures greater than saturated steam pressures and at steam qualities sufficiently high enough to increase the alkalinity of formation waters containing bicarbonates to a pH greater than 10. This dissolves the formation sand grains in the near-wellbore region and create a layer of consolidated sand around the well to control sand inflow into the well. The minerals and fluids that can be used in the aforementioned injection processes are identified in the steam feedwater, formation water, and formation sand analysis contained herein. After completion, the area of sand consolidation is sufficiently rigid to resist sand inflow into the well while remaining porous enough to permit fluid and/or gas flow into or out of the well.

In another embodiment, the method can include locating a sub-surface formation with unconsolidated sands and determining if the one or more of calcium, iron, sulfur, aluminum, barium, magnesium, sodium or silica minerals are in the formation in sufficient quantities for the formation of synthetic cements upon hot water or steam injection. A well is drilled into the formation and a casing is inserted into the well. Perforations are formed in the casing in selected areas of the formation and water is injected water at temperatures of greater than 250° C. down the well and through the perforations. The water has a pH greater than 10, thereby consolidating the foundation sand adjacent to the perforation and providing wormholes sufficient for fluid flow between the well and the formation. In another embodiment, one or more of the above minerals is added to the hot water or steam injection if the information is lacking in minerals needed to form synthetic cements.

The novel sand consolidation process can provide substantial well drilling and completion cost savings by eliminating the need for expensive slotted liner or wire wrapped screen liners, by eliminating the need for changeovers to polymer fluid systems. The process can also eliminate under-remaining and gravel pack operations, replacing them with a simple cased-through cemented completion with a reduced number of standard or extreme overbalanced jet perforations. The productivity of the well is not impacted and there is minor or no sand inflow to the well. Since the consolidation procedure allows production and injection wells to be drilled and completed in virtually the same way, the operator can convert the wells back and fourth in an easy fashion.

Other features and advantages of the invention will become apparent from the following detailed description, taken in conjunction with the accompanying drawings, which illustrate, by way of example, the principles of the invention.

Table 1 provides data from sample wells in which the method of the present invention has been used.

Table 2 provides additional data from sample wells in which the method of the present invention has been used.

Table 3 provides additional data from sample wells in which the method of the present invention has been used.

Table 4 provides additional data from sample wells in which the method of the present invention has been used.

Table 5 provides additional data from sample wells in which the method of the present invention has been used.

Table 6 provides data from a mineral analysis of foundation sands.

Table 7 provides data from a mineral analysis of foundation and injection water.

Tables 8–18 provide mineral content of the formation sands from sample wells in which the method of the present invention has been used.

DETAILED DESCRIPTION OF THE PREFERRED EMBODIMENT

Figure 1:
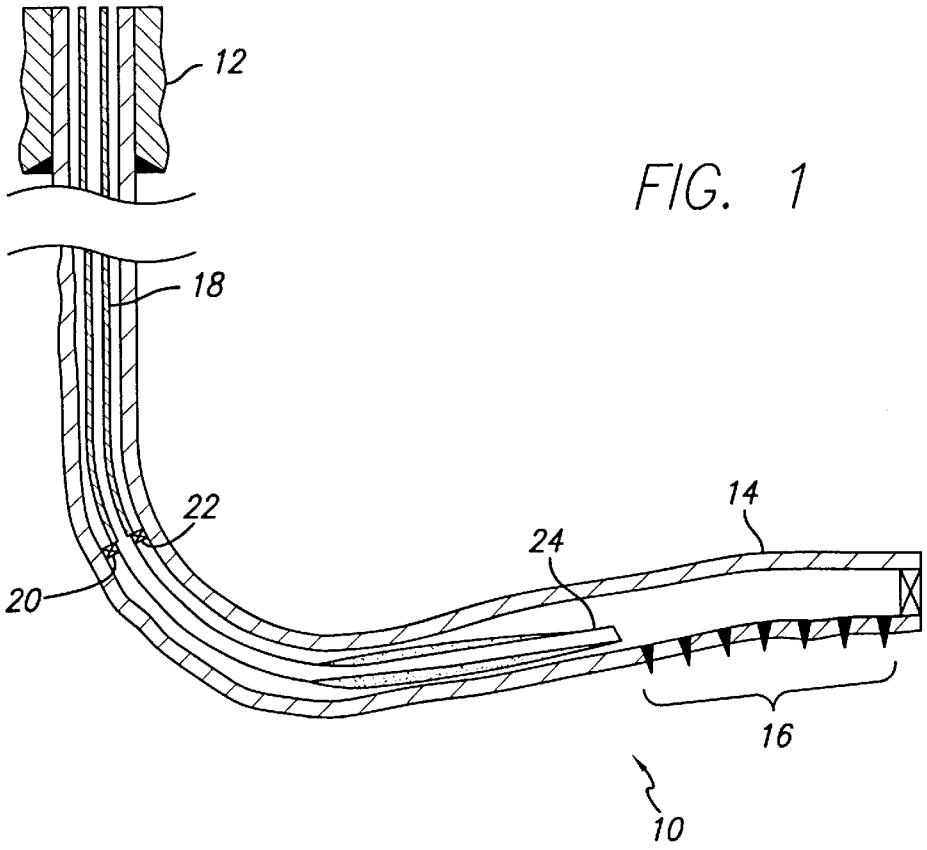
FIG. 1 is a schematic view of a preferred termination of a horizontal well with perforations, according to the present invention.
Figure 2:
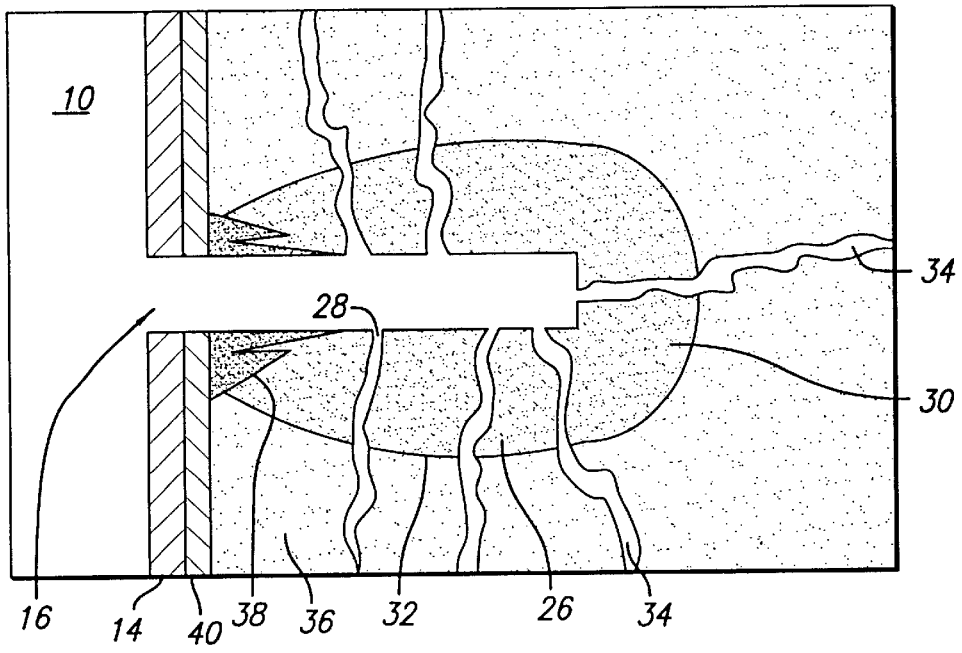
FIG. 2 is a schematic view of one well perforation of FIG. 1.

Referring now to FIGS. 1 and 2 of the drawings, the preferred embodiment of the invention is embodied in a geochemical well completion process for use in completing a horizontal well 10 for oil production or steam injection. The process alternatively can be used to repair oil production or steam injection wells, or to complete horizontally-drilled oil production or steam injection wells.

The well completion process can be used to complete the construction of a vertical steam injection or oil production well as part of a thermal enhanced oil recover ("TEOR ") project. Typically, steam that is mechanically generated in the filed is used in TEOR projects to recover heavy grade highly-viscous crude oil. This process described below could be applied in wells for non-TEOR service, including water flood producing wells or for any type of well requiring sand control, such as production wells or injection wells that handle water, crude oil, natural gas, or other liquids or gases associated with mineral or fluid extraction of injection, or other wells utilized in the petroleum, geothermal and agricultural industries.

The well schematically shown in FIG. 1 is a preferred drilled horizontal well 10 intended for steam injection operation. The well has a surface casing 12 containing a projecting buttress casing 14 perforated with eleven individually selected perforations 16 from 3972' to 4302' from the surface. Within this interval, the perforations are located in sand formation or formations of interest. Each perforation is 0.25 inches in diameter and is formed downhole by methods well known in the oil drilling industry. As described below, perforation sizes can vary according to a specific application. The buttress casing 14 contains insulated tubing 18 connected to an expansion joint 20 and a thermal packer 22. A tubing tail 24 extends beyond the packer and terminates just before the perforations.

The surface casing 12 preferably is a 10.75 inch diameter, 40.5# K-55 ST&C casing. The buttress casing 14 is cemented back to the surface with a conventional cement layer 40 and ends at 4450'. The buttress casing preferably is 7.65 inch diameter, 29.7 L-80 casing inserted into a 9.875 inch hole extending from the surface casing. The insulated tubing 18 is a 4.5 inch outer diameter by 3.5 inch inner diameter size. The packer 22 and expansion joint 20 are sized to fit at the terminus of the insulated tubing, as is known. The tubing tail 24 is made of 2.875 inch diameter tubing. The above components are commercially available in various materials and sizes. Known alternative components can be used depending on the demands of a specific application.

The size and number of the perforations 16 depend on the capacity of the steam source (not shown) and can be calculated according to the known method of Limited Entry Perforating. The greater the size and number of the perforations, the greater the rate of steam flow required. In the formations described herein, a range of 10–80 perforations, each having a diameter of ¼ inch, are appropriate for a steam flow of approximately 210 barrels of cold water equivalent steam per day per perforation, as described herein. Alternatively, a greater steam flow (approximately 840 cold water equivalent barrels per day perforation) could be used with perforations that each have a diameter of ½ inch. The water injected into the well preferably is alkaline water at temperatures above 250° C. and with pH greater than ten. Depending on a particular information, the number and size of the perforations can vary, but the preferably a limited number of 0.25–0.50 inch diameter perforations can be used to dissolve the sand grains in the near-wellbore region. See Tables 1–5 for example perforation and performance data.

Prior to the sand consolidation process, a casing scraper (not shown) can be used to clean the casing 14, which is then rinsed with fresh water. Sand consolidation can be obtained by injecting 80% quality steam through the insulated tubing. For the well example cited above with eleven perforations, approximately 8250 Cold Water Equivalent (CWE) barrels (BBLS) of steam is injected into the well to perform the sane consolidation. However, the sand consolidation is unaffected by the injection of higher volumes. In the beginning of the injection process, the injection rate can be low if formation oil is located adjacent to the perforations. This thick oil resists the injected steam, thereby limiting the volume that can be injected. Over times as the formation heats up, the oil will be driven away from the perforations by the steam. The rate of steam injection increases slowly as the oil obstruction is removed.

The well completion process can be used in unconsolidated or uncemented sands that are of the fine grained arkosic type, with porosity ranges of between 15% and 40%, permeability ranges from 10 to 8,000 milidarcies (md.), with a weighted average of 1000 md. The sand is comprised dominantly of subangular grains of quartz and plagioclase feldspar. See Table 1 for further information. Original oil saturation of this type of sand can be 75% of pore volume.

As shown in FIG. 2 the consolidated sand created by the process is artificially cemented to produce a stable, yet porous area 26 around each perforation 16. See FIG. 2. The sand consolidation process creates patterns of cementation and leaching (otherwise known as "dissolution") around the perforation 16. The consolidation process results in the formation of a perforation tunnel 28 surrounded by a cemented area 30, described in more detail below. The process also results in a thin skin 32 surrounding the cemented area 30 and wormholes 34 adjacent to the perforation 16. The process preferably dissolves the sand grains with large specific surface areas, such as clays, feldspars, and micas, and is less effective on large framework grains such as quartz.

The skin 32 is formed from cementation effects and provides a structural rigidity around the perforation 16 to inhibit sand inflow into the peroration in the well's buttress casing 14. The skin is approximately five millimeters thick, is located close to the heat source, and is not a reservoir wide phenomenon. As a result of the process, the absolute permeability in the skin is reduced, but the wormholes 34 are believed to significantly increase the permeability of the area as a whole. The wormholes provide increased permeability because each wormhole acts as a large diameter fluid pathway from the uncemented formation to the well bore, through the skin 32 and the cemented area 30.

The process increases the overall well productivity and the relative oil permeability, depending upon the quantity and extent of the dissolution wormholes 34 that are created. The wormholes extend outward into the un-cemented formation 36. In particular, the wormholes extend from the perforation tunnel 28 through the skin 32 and into the formation 36 to provide numerous large diameter pathways for fluid flow between the formation and the well. The wormholes 34 may extend a considerable distance into the surrounding non-cemented reservoir rock, thereby enhancing the permeability of the formation.

Ions liberated during the dissolution created by the consolidation process cement at a distance far away from the perforation 16. This cementation does not result in any negative producability problems because the precipitation occurs far enough away from the perforation and is distributed in a large volume of formation sands. Such cementation is avoided because of the low abundance of ions and the large volume of the reservoir rock.

Thin section and x-ray diffraction analyses reveal that the grain composition and grain size of the artificially cemented sand 30 are the same as the formation sand. The sand cementation is believed to occur at temperatures of 250°–300° C. Analysis of artificially cemented sand was performed using various techniques. The distribution, chemical composition, mineralogy and relative order of precipitation of the synthetic cements was analyzed by: 1) thin section analysis (for mineral distribution); 2) integrated scanning electron microscope and energy dispersive spectral analysis (for mineral distribution and chemical composition); and 3) x-ray diffraction analysis (for atomic structure and mineralogy).

Figure 3A:
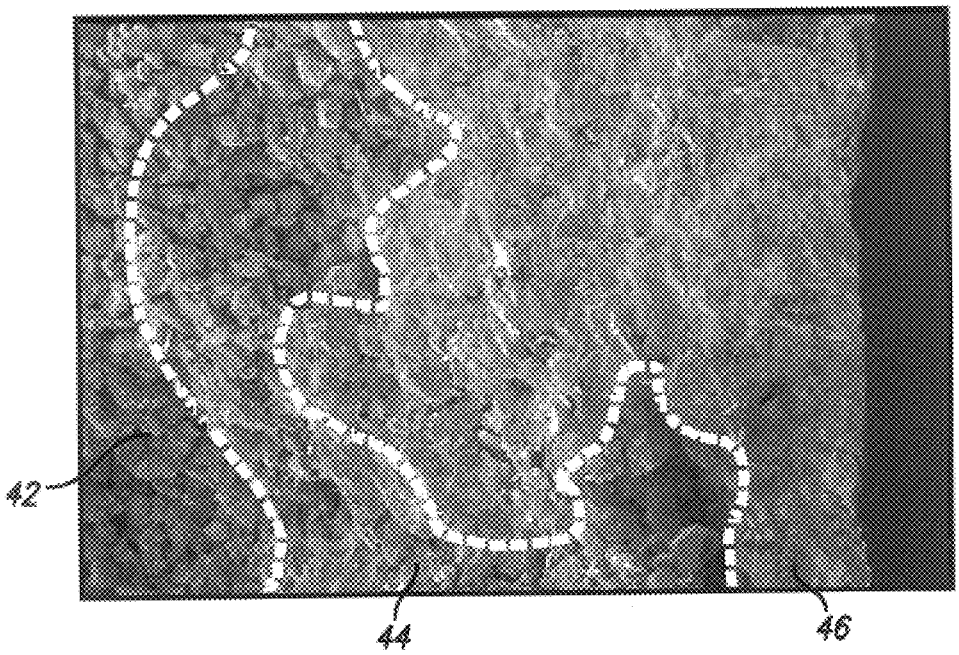
FIG. 3A is an electron microscope photograph of a region including cemented sand according to the method of the present invention.
Figure 3B:
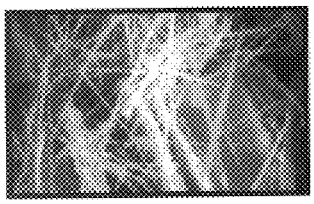
FIG. 3B is an electron microscope photograph of a portion of the cemented sands shown in FIG. 3A, in which the sands have formed an Actinolite cement.
Figure 3C:
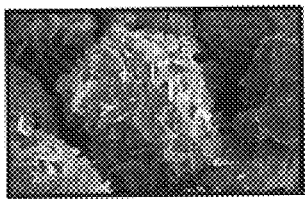
FIG. 3C is an electron microscope photograph of a portion of the cemented sands shown in FIG. 3A, in which the sands have formed a Wollastonite cement.
Figure 3D:
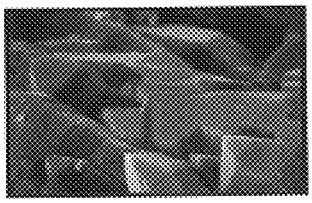
FIG. 3D is an electron microscope photograph of a portion of the cemented sands shown in FIG. 3A, in which the sands have formed a silica cement.
Figure 4A:
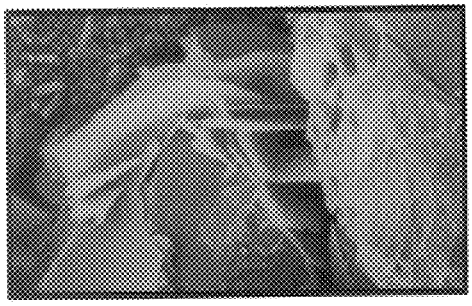
FIG. 4A is photomicrograph of cemented sand forming Wollastonite cement crystals produced according to the method of the present invention.
Figure 4B:
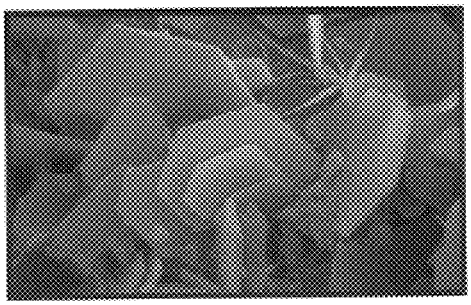
FIG. 4B is an additional photomicrograph of cemented sands forming Wollastonite cement crystals produced according to the method of the present invention.
Figure 4C:
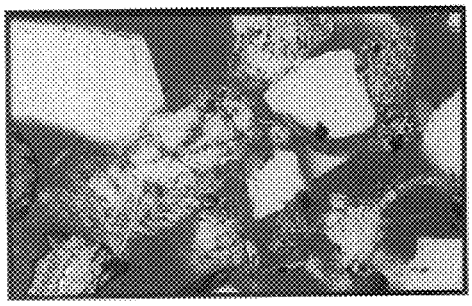
FIG. 4C is a photomicrograph of cemented sands forming Actinolite cement needles produced according to the method of the present invention.
Figure 4D:
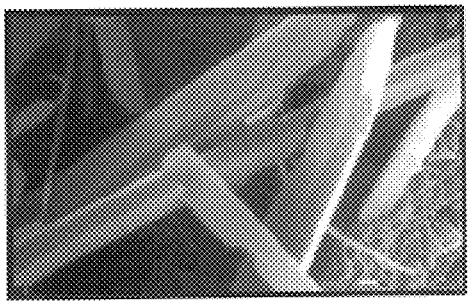
FIG. 4D is an additional photmicrograph of cemented sands forming Actinolite cement needles produced according to the method of the present invention.

FIG. 3A shows cemented sands in which layers of Actinolite 42, Wollastonite 44, and silica 46 cements, each of which are discussed below, are present. FIGS. 3B–3D show, respectively structures of the actinolite, Wollastonite, and silica cements. The analysis discussed above reveals synthetic mineral cements made of three compounds that may or may not have natural counterparts: $SiO_2$, $CaSiO_3$, and $Ca_2(Mg,Fe)_5(OH)_2(Si_4O_{11})_2$. As shown in FIG. 3D, the $SiO_2$ is believed to act as a silica cement occurring with a grain-coating and chalcedony and alpha quartz overgrowths. As shown in FIGS. 4A and 4B, the $CaSiO_3$ is believed to act as a synthetic calcium silicate cement and occurs as well defined, tabular crystals that can include triclinic crystal systems. The actual natural mineral phase of this compound is not known. The closest known natural mineral phase appears to be Wollastonite. Finally, $Ca_2(Mg,Fe)_5(OH)_2(Si_4O_{11})_2$ also can occur in the artificially cemented sand. This complex cement (referred to herein as "Actinolite") occurs as accicular, or needle-like, crystals, as shown in FIGS. 4C and 4D. The actual mineral phase is not known, but the closest known natural mineral phase probably is Actinolite. It should be appreciated that one or two of all three of the cements may form around the perforations 16, depending on the temperature, fluid alkalinity and contact time of the fluid with the sand grains of a particular sand consolidation process. It also should be appreciated that alternative synthetic silicate cement compounds could be formed with known alternative elements.

If found around a perforation 16, the silica cement area 38 will tightly cement sand grains with grain coating silica ($SiO_2$). The silica cement may form in a small area 38 around, but not over, the perforation. Formation of more silica cement is undesirable because the porosity of such a silica cement is very low and should be less than 1%. The silica cement area thus is essentially impermeable because pores and pore throats are filled with silica cement. When present, the silica cement coats all of the sand grains in the silica cement area, regardless of the sand grain composition. Because the silica cement forms at less than 150° C., immediately cooling the well below this temperature could result in the formation of unwanted silica cement. However, the injection of large amounts of steam according to the process moves silica cement far enough away from the perforations so that no producability problems will be encountered, even if the well is cooled and used to draw oil from the formation. The number of perforations preferably is limited to maintain sufficient steam flow through each perforation so as to move the silica away from each perforation and into the formation.

If also found around a perforation 16, the $CaSiO_3$ calcium silicate cement area 30 would include sand grains that have been artificially cemented by mostly synthetic calcium silicate in a crystal form. The calcium silicate crystals form box-work structures of tabular crystals that extend from one grain to the next, loosely cementing adjacent grains. This layer has high porosity (>25%) and a high permeability even though the calcium silicate cements bridge the pore throats.

If also found around a perforation, the Actinolite cement area 30 would include sand grains that are very loosely cemented by the needle-like crystals. If it exists, the boundary between the calcium silicate area and the Actinolite area is not well defined and considerable overlap occurs. The Actinolite area has a high porosity (>25%) and a high permeability, even though the Actinolite bridges the pore throats.

Reactions that involve cementation require a source of ions from dissolution (leaching) and precipitation (nucleation and crystal growth). In particular, the reactions require a source of silica, calcium, or iron to form synthetic cements in the sand. Thin section analysis reveals that these ions are provided, in large part, by the dissolution of sand grains with large specific surface areas, such as clays, feldspars, and micas. Mineral dissolution is aided by high temperature and high pH. The solubility of silica increases sharply above pH 9.5 and 150° C., so the injection water or steam should have a pH of 9.5 or greater. Water temperature in the annulus preferably is greater than 250° C. Solution pH of the liquid effluent in steam injection systems is high (10 to 12). Thus, the temperature and pH of the fluid system in steam injection operations is ideal for dissolution of silicate minerals.

Other types of synthetic silicate cements could be formed, depending on the temperature, water alkalinity, contact time, and the concentration of minerals. Alternative cements may also include oxides of other metals. For example, silicon, iron, sulfur, and aluminum, among other elements, can be found in the foundation rock and could be used. Calcium, magnesium, barium and sodium can be found in the foundation water or the injected steam. Table 6 provides data from an analysis of formation mineral content, and Table 7 provides data from an analysis of process water content. Tables 8–18 show mineral analysis of formations from sample wells.

After the sand consolidation process is used, there is significant selective dissolution of grains with large specific surface areas, which can be feldspar and igneous rock fragments. Plagioclase feldspar is abundant and it has a somewhat variable composition, depending on the relative abundance of Albite (Ab) and Anorthite (An) end members. The compositions can be expressed for Ab as $NaAlSi_3O_8$ and for An as $CaAl_2Si_2O_8$.

In the formation sands, the plagioclase feldspar components range in the composition from An 10 to An 50. Dissolution of plagioclase feldspar thus provides a source for both silica and calcium. The calcium silicate cement preferably is precipitated on the feldspar grains, suggesting that a local mineral source for calcium may be important. However, it should be appreciated that the calcium silicate cement is not exclusively restricted to precipitating on feldspar grains. A likely source of calcium is the naturally occurring, or connate water in the formation, which preferably contains approximately 500 mg/l of calcium. Another possible, but less likely, source is the softened fresh water injected as the steam injection. This water contains approximately 0.2 mg/l of calcium. In this particular application, the water near the perforation after sand consolidation operations has significantly lower concentrations of calcium, from 8–193 mg/l due to the geochemical reactions mentioned above and from dilution of the formation water with the water forming the injected steam.

The precipitation of Actinolite requires a source of iron (Fe) and/or magnesium (Mg). These elements are provided by iron-rich minerals in the formation. Iron rich minerals in the sand formation include mica, and specifically biotite having a composition of $K_2(Mg,Fe)_2(OH)_2(AlSi_3O_{10})$. Actinolite preferably is precipitated on the biotite grains. However, it should be appreciated that the Actinolite is not exclusively restricted to precipitating on biotite grains, thereby suggesting that iron is provided from the leaching of minerals in the formation.

Figure 5A:
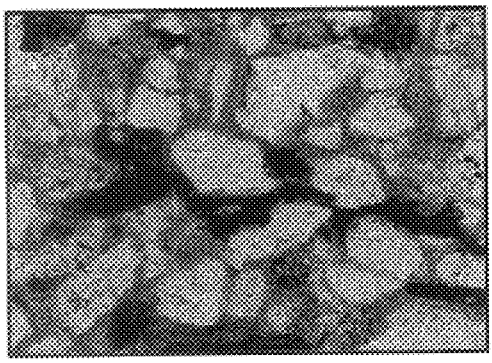
FIG. 5A is a thin section photomicrograph of a well core prior to introduction of steam according to the method of the present invention.
Figure 5B:
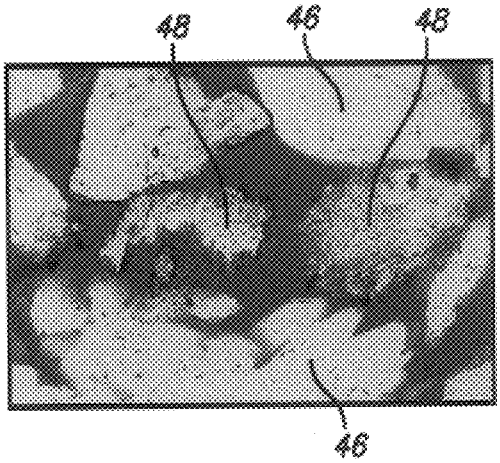
FIG. 5B is a thin section photmicrograph of a well core in which partial dissolution has taken place after introduction of steam according to the method of the present invention.

Dissolution of the outer surfaces of the quartz grains ($SiO_2$) provides an additional importance source of silica ions. However, there is no evidence of the dissolution of whole quartz grains. The rate of dissolution of any solid is dependent on the surface area of the solid. Thus, although quartz is soluble at elevated and high pH values, dissolution of individual grains is probably restricted to surface pitting, not internal leaching. As shown in FIGS. 5A and 5B, in the silica cement and/or calcium silicate cement areas, the size of quartz grains is increased significantly as a result of precipitation of silica cement on the grain surfaces.

The relative order of crystallization of the synthetic cements, as determined through thin section and electron microscope analysis, is that calcium silicate cement is formed first, followed by Actinolite. The silica cement is the last cement to precipitate. In the presence of water, the formation of the calcium silicate cement requires a minimum temperature of approximately 300° C. for precipitation. Actinolite requires a lower temperature of approximately 250° C. Silica cement forms at relatively low temperatures (150° C.). These synthetic cements can be formed during cooling after the steam injection is finished.

Such reactions do not require much time—they can occur within minutes in the presence of hot water.

Precipitation of silica is a late stage event because silica is the lowest temperature mineral phase in solution. Silica precipitation thus occurs after steam injection in areas of most rapid temperature loss when the area by the perforation cools. The areas of most rapid temperature loss include 1) the area of sand closest to the heat source, 2) the area of sand at the greatest distance from the heat source. Intermediate areas remain hotter for a longer period of time because rock is a poor conductor of heat. These areas are dominated by the high temperature Actinolite and calcium silicate cements.

The precipitation of the synthetic cements reduces the permeability of the sand because the cements occur in the pore throats. However, the chemical reactions described herein involve mineral dissolution as well as cement precipitation. As shown in FIG. 5B, the chemically unstable grains in the cemented sand show evidence of selective dissolution. Dissolution is selective for grains with inherent planes of weakness and high surface area. Feldspar grains are leached along cleavage planes. In particular, microcrystalline feldspathic grains (igneous rock fragments) are extensively leached because of small crystal size and high specific surface area.

Figure 5C:
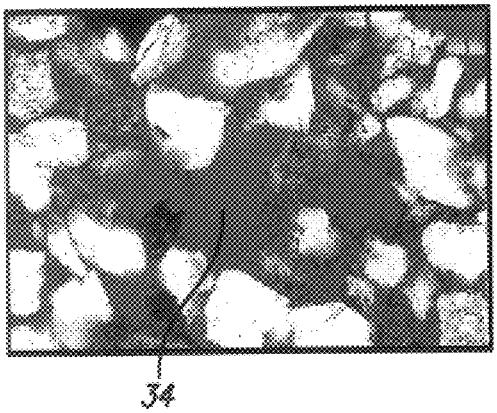
FIG. 5C is a thin section photomicroprocessor of a well core in which dissolution wormholes have formed due to introduction of steam according to the method of the present invention.
Figure 5D:
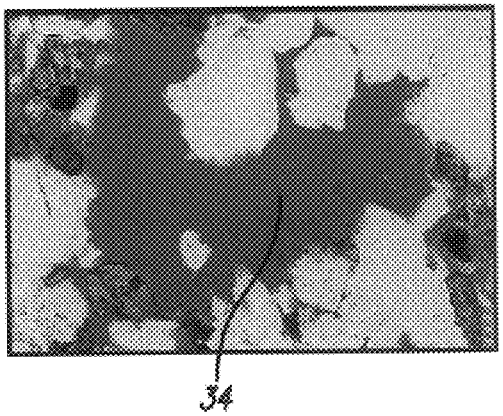
FIG. 5D is an additional thin section photomicrograph of a well core in which dissolution wormholes have formed due to introduction of steam according to the method of the present invention.

Extensive grain dissolution occurs in the formation sands because chemically unstable grains are abundant. As shown in FIGS. 5C and 5D, dissolution of groups of adjacent feldspathic grains produces very large secondary pores. These large secondary pores are known as wormholes 34 and are significantly larger than the original intergranular pores (as shown by comparison of FIGS. 5A and 5D). Leached grains and dissolution wormholes have not been observed in conventional cores taken from pre- and post-steam injection areas. Thus, the wormholes are restricted to areas of high heat transfer, such as immediately adjacent to the well bore in steam injection wells. Grain dissolution occurs before the precipitation of synthetic cements and is a high temperature event. However, lower temperatures can create lower temperature cements.

The impermeable silica cemented layer 38 forms in areas of rapid heat loss, such as the area within a few millimeters of the well's buttress casing 14. Adjacent sand farther away from the buttress casing can be cemented with calcium silicate and Actinolite cements. Silica precipitates away from the buttress casing, especially in areas where temperatures are relatively low from steaming. The silica precipitation in these areas will not lead to significant grain cementation because of the large number of quartz grains and the relatively low abundance of dissolved silica. The quartz grains serve as nucleation sites for the cementation process.

Because of the shape, or habit, of the calcium silicate and Actinolite crystals, these cements form loose bonds between adjacent grains in areas of low grain volume, such as the area near each perforation 16. Because of these loose bonds, the rock framework is stabilized but is not rigid. The skin 32 around each perforation is loosely cemented and may fail if high differential pressures exist across the formation face. Therefore production should be increased gradually. The well should not be shocked by pumping the fluid level down quickly.

The porous yet structurally rigid cement formation provided by the sand consolidation process 26 is significantly enhanced by the presence of chemically unstable sand grains in the formation, such as feldspars and/or rock fragments. These feldspars and/or rock fragments enhance permeability in the skin and the surrounding reservoir. Thus, the sand consolidation process is suited for "dirty" formations, or reservoirs, which are reservoirs with a high proportion of chemically complex sand grains. Minerals suitable for the sand consolidation process may thus already exist in dirty reservoirs.

"Clean" reservoirs are uniform and could consist almost entirely of quartz grains. Such clean reservoirs may experience cementation but there should be little or no significant development of secondary porosity because of the creation of dissolution wormholes involves the complete dissolution of framework grains. In a clean quartz-rich reservoir, the sand consolidation process may lead to a significant reduction of formation permeability. Accordingly, for such reservoirs, the steam or water injection stream should contain added ions to enhance permeability. Such minerals preferably could include calcium, iron, sulfur, aluminum, barium, magnesium, barium, sodium and silica. Ions could be created in injection water or steam by adding these minerals in powdered form or in other forms with high specific surface areas. Other minerals could be used depending on the cement compound sought for the end result.

Steam can be supplied from any source, such as by a cogeneration plant, at an average rate of 28,000 bbl/day cold water equivalent, greater than 1300 psig and 75% steam quality. Steam generator feedwater can be fresh water that has been deaerated and softened. Steam qualities of 45%–100% have bene measured at studied wells. Alternatively, a downhole steam generator could be used. Injections of hot water instead of steam could also be used to consolidate the sand formation.

One embodiment of the method includes injecting alkaline water into the formation at high temperatures above 250° C. and with pH greater than 10 through a limited number of 0.25–0.50 inch diameter perforations to dissolve the sand grains in a near-wellbore region. Significant heat loss and fluid pH reduction occurs in the near-wellbore region as the hot injected fluids go through the perforations, mix with the formation waters, and disperse into the formation sands. The resultant temperature and fluid pH decline rapidly with distance from the wellbore which cause reprecipitation of the dissolved sand grain minerals (primarily calcium, magnesium, aluminum, iron, barium, sodium, sulfur, and silica) into complex synthetic silicate cements which bond the remaining unconsolidated sand grains in the formation around the well to control sand inflow into the well.

Another embodiment applies to geologic formation sands which are unconsolidated but do not contain adequate quantities of the minerals needed to create the complex synthetic silicate cements. The necessary minerals are added and solubilized into the high temperature alkaline water prior to injecting the fluid through the perorations so the dissolved formation sand grains. The supplemental solubilized minerals can react with the formation waters in the near-wellbore region to create the complex synthetic silica cements to bond the unconsolidated sand grains around the well and thereby control sand inflow into the well.

In another embodiment, the method can include injecting high temperature steam at pressures greater than saturated steam pressures and at steam qualities sufficiently high enough to cause the steam condensate effluent to have an alkaline pH greater than 10. The effluent dissolves the formation sand grains in the near-wellbore region and creates a layer of consolidated sand around the well to thereby control sand inflow into the well.

In yet another embodiment, the method can include injecting high temperature steam at pressures greater than saturated steam pressures and at steam qualities sufficiently high enough to increase the alkalinity of formation waters containing bicarbonates to a pH greater than 10. This dissolves the formation sand grains in the near-wellbore region and create a layer of consolidated sand around the well to control sand inflow into the well. The minerals and fluids that can be used in the aforementioned injection processes are identified in the steam feedwater, formation water, and formation sand analysis contained herein. After completion, the area of sand consolidation is sufficiently rigid to resist sand inflow into the well while remaining porous enough to permit fluid and/or gas flow into or out of the well.

Wells in which the sand consolidation process has been used have sustainable high productivity rates. The wells averaged commercially acceptable levels of gross production per day per well well after their initial cyclic steam stimulation and sand consolidation completion treatments. Such rates are equivalent to a gross rate that would be expected from full interval vertical wells with a gravel-packed slotted liner construction. In order to create larger numbers of sand consolidated perforations while maintaining the required steam injection amounts, individual sets of perforations can be consolidated and the well can be plugged above the perforations in order to create another set of perforations while maintaining steam flow rates. The cement bonds formed by the process tend to be resistant to hydrochloric acid. Thus, scale and other formation damage can still be treated effectively with acid.

The novel sand consolidation process can provide substantial well drilling and completion cost savings by eliminating the need for expensive slotted liner or wire wrapped screen liners, by eliminating the need for changeovers to polymer fluid systems. The process can also eliminate under-reaming and gravel pack operations, replacing them with a simple cased-through cemented completion with a reduced number of standard or extreme overbalanced jet perforations. The productivity of the well is not impacted and there is minor or no sand inflow to the well. Since the consolidation procedure allows production and injection wells to be drilled and completed in virtually the same way, the operator can convert the wells back and forth in an easy fashion.

The procedure also optimizes reservoir management by allowing selective perforating in injection and production wells. This helps assure control of the steam injection profile and production from only desirable sand formations. The few perforations required in this completion technique provide great flexibility in the rework or completion of a well. This is because steamed out perforations can be sealed by cement, new perforations can be created and the sand by such new perforations can be consolidated as described above. This cannot be accomplished by a conventional slotted liner. The preferred process therefore is more flexible and less expensive.

While a particular form of the invention has been illustrated and described, it will be apparent that various modifications can be made without departing from the spirit and scope of the invention. Thus, although the invention has been described in detail with reference only to the preferred embodiments, those having ordinary skill in the art will appreciate that various modifications can be made without departing from the invention. Accordingly, the invention is not intended to be limited, and is defined with reference to the following claims.

We claim:

1. A method for consolidating sand in a well, comprising:

locating a sub-surface formation containing unconsolidated sands;

determining whether minerals are present in the formation in sufficient quantities for the formation of complex synthetic silicate cements upon hot water or steam injection into the formation;

drilling a well into the formation;

inserting a casing into the well;

forming perforations in the casing; and injecting water down the well and through the perforations, the water thereby consolidating the foundation sand adjacent to the perforations to form complex synthetic silicate cements and providing wormholes sufficient for fluid flow between the well and the formation.

2. The method of claim 1, wherein the minerals comprise one or more of the elements in the group comprised of calcium, iron, sulfur, aluminum, barium, magnesium, sodium or silicon.

3. The method of claim 1, wherein the water has a pH of 9.5 or greater.

4. The method of claim 1, wherein the water has a temperature of 250° C. greater.

5. The method of claim 1, wherein the size and number of perforations are selected based upon the amount of water injected into the well to prevent flow of sand through the perforations.

6. The method of claim 1, wherein the number of perforations is eleven.

7. The method of claim 1, wherein the perforations have diameters ranging from 0.25 to 0.50 inch.

8. The method of claim 1, wherein the perforations are located in the casing at points selected to be suitable for an intended service of the well.

9. The method of claim 1, further comprising a step of adding one of more types of minerals to water in sufficient quantities for the formation of synthetic cements upon injection of the water into the formation, if the minerals have been determined to not be present insufficient quantities, before the step of injecting water down the well.

10. The method of claim 1, wherein the water is in the form of steam at a pressure greater than that of saturated steam at the same temperature.

11. The method of claim 1, wherein the formation has a high proportion of chemically complex sand grains.

* * * * *

UNITED STATES PATENT AND TRADEMARK OFFICE

CERTIFICATE OF CORRECTION

PATENT NO. : 6,554,067 B1
DATED : April 29, 2003
INVENTOR(S) : David K. Davies et al.

It is certified that error appears in the above-identified patent and that said Letters Patent is hereby corrected as shown below:

Column 1,
Line 62, “said” should be -- sand --.

Column 2,
Line 17, “causes” should be -- cause --.
Line 37, “pressure” should be -- pressures --.

Column 3,
Line 7, “information” should be -- formation --.
Line 14, “under-remaining” should be -- under-reaming --.
Line 21, “fourth” should be -- forth --.
Line 37, “sand” should be -- sands produced --.
Line 49, after “is” insert -- a --.
Line 49, “sand” should be -- sands --.
Lines 58 and 65, “photmicrograph” should be -- photomicrograph --.

Column 4,
Line 1, “photomicroprocessor” should be -- photomicrograph --.
Line 9, after “provides” insert -- well --.
Lines 11, 13, 15 and 17, after “additional” insert -- well --.
Line 24, after “content” please insert -- data --.
Line 40, “recover” insert -- recovery --.
Line 42, “filed” insert -- field --.
Line 48, “of” should be -- or --.

Column 5,
Line 2, “7.65” should be -- 7.675 --.
Line 22, after “day” insert -- per --.
Line 26, “information” should be -- formation --.
Line 38, “sane” should be -- sand --.
Line 44, “times” should be -- time --.
Line 58, please delete “See FIG. 2.”

Column 6,
Line 5, “peroration” should be -- perforation --.

Column 7,
Line 14, after “cement” insert -- area --.

UNITED STATES PATENT AND TRADEMARK OFFICE

CERTIFICATE OF CORRECTION

PATENT NO. : 6,554,067 B1
DATED : April 29, 2003
INVENTOR(S) : David K. Davies et al.

It is certified that error appears in the above-identified patent and that said Letters Patent is hereby corrected as shown below:

Column 8,
Line 6, “show” should be -- provide --.
Line 6, after “analysis” insert -- data --.
Line 47, “importance” should be -- important --.

Column 10,
Line 28, “bene” should be -- been --.
Line 54, “perorations” should be -- perforations --.
Line 57, “silica” should be -- silicate --.

Signed and Sealed this

Ninth Day of September, 2003

JAMES E. ROGAN
*Director of the United States Patent and Trademark Office*